US005365860A

United States Patent [19]

Billington, III

[11] Patent Number: 5,365,860

[45] Date of Patent: Nov. 22, 1994

[54] MANUALLY-ADJUSTABLE CANTILEVERED WORK STATION PLATFORM

[75] Inventor: Charles J. Billington, III, Modesto, Calif.

[73] Assignee: Billington Welding & Manufacturing, Inc., Modesto, Calif.

[21] Appl. No.: 957,773

[22] Filed: Oct. 8, 1992

[51] Int. Cl.[5] ..... A47B 9/00

[52] U.S. Cl. ..... 108/108; 108/110; 108/148; 182/113; 182/145; 182/222

[58] Field of Search ..... 108/108, 110, 148; 248/244, 246, 297.3, 297.5; 182/113, 145, 222

[56] References Cited

U.S. PATENT DOCUMENTS

| | | | |
|---|---|---|---|
| 291,030 | 1/1884 | Clapper | 108/108 |
| 652,836 | 7/1900 | Covert | 248/297.3 |
| 830,943 | 9/1906 | Wessels | 108/108 |
| 845,917 | 3/1907 | Worley | 108/108 |
| 848,991 | 4/1907 | Harvey | 108/148 |
| 1,826,643 | 10/1931 | Anderson | 248/297.3 |
| 3,601,256 | 8/1971 | Bowers | 108/108 |
| 4,869,343 | 9/1989 | Anderson | 182/113 |
| 5,060,754 | 10/1991 | Feick | 182/113 |
| 5,158,157 | 10/1992 | Billington et al. | 182/113 |

*Primary Examiner*—Michael J. Milano

*Attorney, Agent, or Firm*—Flehr, Hohbach, Test, Albritton & Herbert

[57] ABSTRACT

A portable, manually adjustable work station (10, 60) for use on a support surface. The work station (10, 60) includes a frame assembly (12) and a platform member (18, 68). The frame assembly (12) has a base portion (14, 72) and a support portion (16, 70) extending vertically from the base portion (14, 72). The work station (10, 60) further includes a mounting assembly (30, 80) cantilever mounting the platform member (18, 68) to extend from at least one side of the support portion (16, 70) in several elevated positions relative to the base portion (14, 72). The mounting assembly (30, 80) is formed for movement between the elevated positions upon unweighting and tilting of the platform member (18, 68), and for automatic securing of the platform member (18, 68) in a selected elevated position upon rotating in the reverse direction and weighting of the platform member (18, 68). The base portion (14, 72) extends laterally from the support portion (16, 70) by an amount sufficient to support the platform member (18, 68) in a stable elevated position over the support surface with a person standing at any location on the platform member (18, 68). An adjustable and movable support assembly (66), preferably in the form of a seat support (88), also may optionally be mounted to the platform (18, 68).

22 Claims, 2 Drawing Sheets

MANUALLY-ADJUSTABLE CANTILEVERED WORK STATION PLATFORM

TECHNICAL FIELD

In general, the present invention relates to work station platforms- More particularly, the present invention relates to manually-adjustable platforms for use as a work station on a support surface.

BACKGROUND ART

Manufacturing and other processes often involve a worker standing at a station for an extended period of time to perform a manual task. For example, the process may require the worker to stand before a conveyor belt and sort through articles carried along the belt, removing those which are defective. The operation may include the partial assembly of a part as it passes by on a conveyor belt. In other processes, the worker may be positioned before a stationary, built-in work station. When standing before a conveyor belt or a stationary work station, the workman is generally manipulating objects on a surface having a fixed, predetermined height. Depending on his physical stature, the worker may have difficulties in efficiently performing the required tasks, particularly over long periods of time.

A conveyor belt or stationary work surface is constructed having a height relative to the size of an average person. If the workman is smaller in stature than the average, he will not be able to comfortably work at the station. His arms must extend in an upward direction towards the belt. Over time, the upward-reaching motion will induce muscle fatigue in the upper arm, shoulder and neck areas. He will not have an unrestricted view of the entire work surface. If the job requires removing defective or damaged articles, the workman's efficiency is substantially reduced since many defective items will pass by the station unnoticed. A section of the work surface opposite the workman will likely be out of reach, since he is not tall enough to lean across the surface. Similarly, the shorter worker may not effectively reach the area directly above the work station surface. This may present a problem for the worker standing before a stationary work surface or assembling a part passing by on a conveyor belt. Thus, the worker's height greatly affects his job capabilities.

Providing a platform or raised surface for the shorter worker to stand upon would greatly enhance job performance. Supporting the worker upon a platform would elevate him or her to a height approximating that for which the work surface was designed, providing him or her with convenient access to all essential work areas. The development of muscle strain and fatigue would be substantially prevented since the upper body would be properly positioned relative to the work area.

The prior art platform structures available for use as a work station are generally bolted, welded or otherwise fixed or secured to the floor. The fixed platform is protected from accidental tipping. The platform may not be taken from the work area, and the proper placement of the structure relative to the work surface is assured. Further, securing the platform to the floor reinforces the stability of the structure to safely withstand the weight of the worker. However, the use of the fixed platform is substantially restricted. The shorter worker is limited to either working at the exact location of the platform, or standing directly on the floor. Moving the mounted structure from one work station location to another is inconvenient, time consuming and even impractical, depending on the mounting method used. Taller workers must constantly avoid and move around fixed platforms, which pose a hazard in the work place when not in use. The fixed platform structure is particularly cumbersome in a manufacturing facility operating with more than one shift. When the worker terminates his or her employment, the platform structure must be removed unless she is replaced by a worker of comparable height.

A platform suitable for use in a manufacturing facility and providing an elevated surface which could be readily moved from one location to another would eliminate many of the risks and inconveniences which accompany the fixed platform. The portable platform could be transported to a storage area when not in use, removing a hazardous obstacle from the work area. If the worker is transferred to another location, the portable platform could be conveniently moved from one work station location to the other.

Since every worker has a different stature, the height at which the platform should be elevated depends upon the individual. Platform structures are available having several different heights. To fully accommodate its workers, a manufacturing facility must provide several structures each elevated to a different height. With a portable platform, this creates significant storage and administrative problems. Alternatively, the facility may opt to provide the shorter worker with a standard platform structure elevated at a representative height. Offering a standard platform structure eliminates many of the inconveniences found with supplying structures of different heights, but does not provide a complete solution. The standard height provided by the raised surface will be insufficient for several workers, and excessive for others. The shorter will encounter the same efficiency and fatigue problems as found without the platform. The taller ones have the option of standing on the floor and reaching upward to the work surface, or standing on the platform and bending toward the work surface. Both alternatives lead to the development of muscle fatigue and soreness.

A platform surface which may be adjustably elevated to one of several heights would be adaptable to the stature of the individual worker. Each worker would be raised to the proper elevation relative to the work surface, reducing physical strain and maximizing efficiency. The adjustable platform structure may be readily used by many different workers.

Standing before a work surface throughout an entire shift is physically fatiguing. As the worker tires, his or her performance efficiency is reduced. The muscle strain developing in the leg and back areas while the worker stands on a platform substantially reduces his or her productivity. Providing a support for the worker to lean against would significantly reduce physical fatigue and improve the worker's efficiency. One option is to provide a raised chair or stool on the platform. While effectively reducing physical strain in the legs, the chair or stool dramatically alters the worker's posture relative to the work surface. When in the sitting position the upper body is set back from the work station, while when standing it is held immediately in front of the work surface. The sitting worker must lean forward to reach the work area, straining the shoulders and lower back. Similarly, sections of the work area would be beyond the sitting worker's reach. Providing a chair or stool would reduce some physical fatigue, but would not improve efficiency or productivity.

A platform structure provides a surface of limited size for the worker to stand upon. A stool, chair or large support structure will not fit upon this limited surface. Placing the larger support structure on the floor adjacent the platform would be impractical. The worker would be confined to the section of the platform adjacent the support. Further, the support must be elevated at an appropriate height relative to the raised surface to provide the required support.

To provide optimum support, the support structure must be positioned to contact the proper part of the worker's body. An adjustable support structure would be adaptable to the stature of the worker and his or her position on the platform. An adjustable support structure would reduce muscle fatigue and vastly improve efficiency and performance.

Accordingly, a portable platform structure which may be readily moved from one location to another is highly desirable. A platform surface which is adjustable to several different heights for accommodating the stature of an individual worker is similarly desirable. An adjustable support assembly for supporting a worker on a raised platform is particularly desirable. In addition, a platform structure which is low in cost, easy to manufacture and convenient to store, adjust and use would be extremely useful.

A primary object of the present invention, therefore, is to provide a platform for use as a work station which is portable, and which may be conveniently moved from one location to another.

Another object of the present invention is to provide a platform for use as a work station which may be manually elevated to a selected one of several heights.

Yet another object of the present invention is to provide a platform for use as a work station which includes a support assembly for supporting a worker standing upon the platform.

A further object of the present invention is to provide a support assembly which is adjustable relative to the stature and position of a person standing upon the platform.

Yet another object of the present invention is to provide a platform for use as a work station which will safely support a person standing upon the platform, and which will improve the person's comfort, efficiency and productivity.

A more general object of the present invention is to provide a platform for use as a work station which is easy to manufacture, low in cost and convenient to use, move and store.

The platform and support assembly of the present invention have other objects and features of advantage which will become apparent from and are set forth in more detail in the description of the Best Mode for Carrying Out the Invention and the accompanying drawings.

DISCLOSURE OF THE INVENTION

The portable, manually-adjustable platform for use as a work station of the present invention includes a frame assembly and a platform member of sufficient size to support a person standing on the platform member. The frame assembly has a base portion which is suitable for positioning on a support surface, and a support portion vertically extending from the base portion. The base portion of the frame assembly is movable with respect to, and self-supporting on, the support surface. A mounting assembly cantilever mounts the platform member to extend from at least one side of the support portion in one of several elevated positions relative to the base portion. Upon unweighting of the platform member, the mounting assembly releases the platform member for movement between elevated positions. The mounting assembly automatically secures the platform in a selected position upon weighting of the platform. The base portion extends laterally from the support portion by an amount sufficient to support the platform member in a stable elevated position with a person standing at any location upon the platform member.

In another aspect of the present invention, a manually-adjustable, work station apparatus for supporting a person when standing in a substantially upright position on a work station platform is provided. The apparatus includes a support assembly mounted to the platform and having a seat support formed for engaging a part of a person's body to provide support. A position adjustment device is mounted to the support assembly for positioning the seat support in one of a plurality of positions relative to a person standing on the platform. A deployment device is mounted to the support assembly for moving the seat support between a deployed position and a stored position. When in the deployed position, a person standing on the platform may lean against the seat support. A person may step onto or off of the platform when the seat support is in the stored position.

BEST MODE OF CARRYING OUT THE INVENTION

Figure 1:
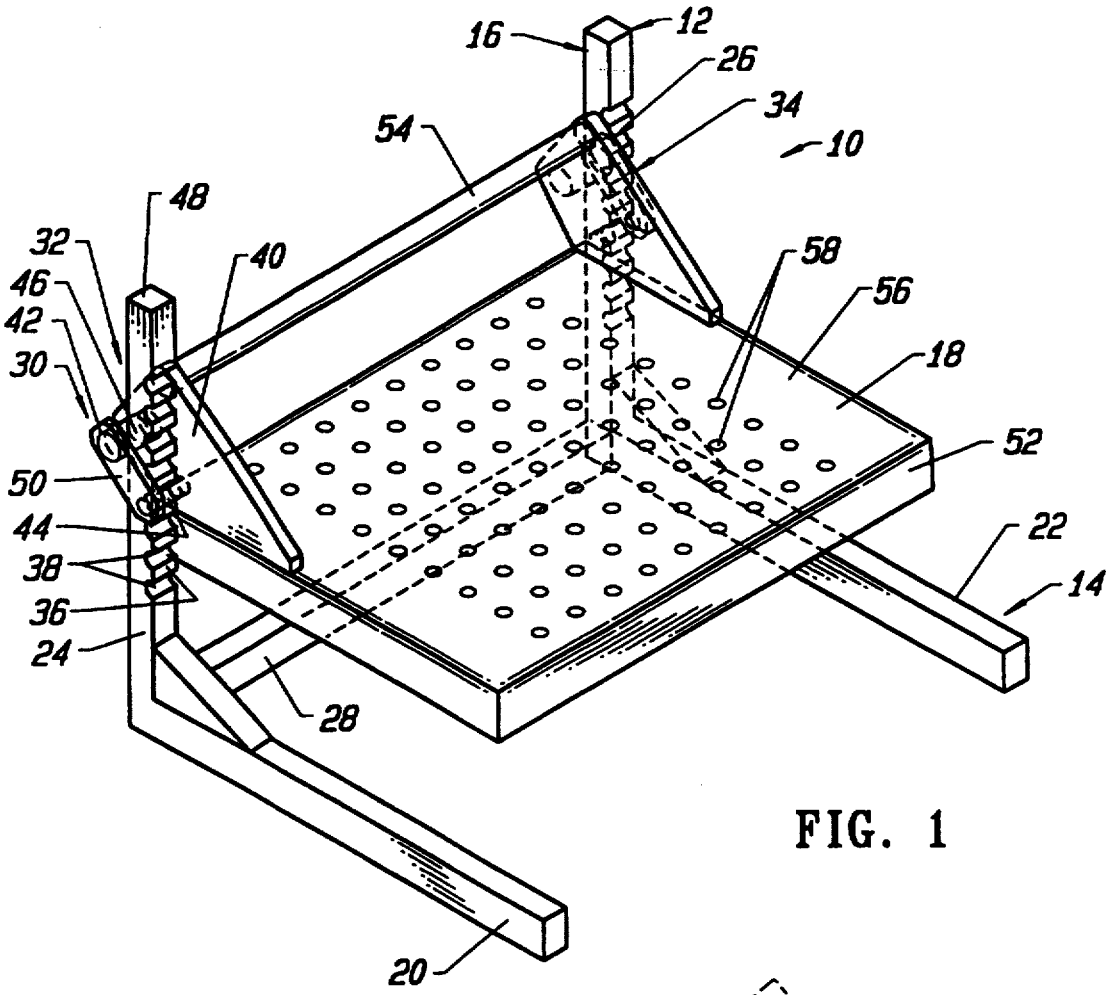
FIG. 1 is an isometric view of a platform for use as a work station constructed in accordance with the present invention.

Reference will now be made in detail to the preferred embodiments of the invention, which are illustrated in the accompanying Figures. Turning now to the drawings, wherein like components are designated by like reference numerals throughout the various figures, attention is directed to FIGS. 1 and 2.

A platform for use as a work station 10 on a support surface, designed in accordance with the present invention, is shown in FIG. 1. The portable, manually-adjustable work station 10 includes a frame means or assembly 12, which may include a base portion 14 and a vertically extending support portion 16, for supporting a cantilever-mounted platform member 18. The work station is portable, with the base portion being moveable on a support surface. In the preferred form, the bottom surface of base portion 14 is smooth, facilitating movement of assembly 10 relative to the support surface. As is shown in FIG. 1, in the preferred form work station 10 is self-supporting, that is, the base portion is not mounted, fixed or otherwise secured in place. The work station is stable without anchoring base portion 14 to an external structure, thereby allowing for convenient movement of the work station from one location to another.

In the preferred form, base portion 14 includes a pair of first and second feet 20 and 22 extending outwardly of platform 18 from support portion 16. Feet 20 and 22 have a length greater than the cantilevered length of platform 18. The base portion is thereby formed to support platform member 18 in a stable orientation with a person standing at any location upon the platform.

Support portion 16 is provided by a pair of laterally-spaced first and second support posts 24 and 26. The vertically oriented support posts 24 and 26 are positioned adjacent opposite sides of platform member 18. The platform is cantilever mounted to the support posts, extending laterally from the support portion between support posts 24 and 26. The support posts and base portion 14 are preferably integrally formed, with frame means 12 being thereby provided by a pair of L-shaped members having a leg portion and a foot portion. A cross-connecting member 28 joins the first support post 24 and foot 20 to the second support post 26 and foot 22. The cross-connecting member provides additional stability for the frame and holds the L-shaped members together.

The platform of the present invention provides a stable, raised support for a person to safely stand upon. With the integral L-shaped members and cross-connecting member 28, the frame is not excessively heavy, and work station 10 may conveniently be moved from one location to another. Since base portion 14 extends substantially beneath platform member 18, the amount of space required for storage is only slightly greater than the amount of surface area provided by the platform member.

While the present embodiment incorporates a pair of feet, the base portion may be provided by a solitary, wider foot extending in substantially the same direction as platform member 18. The actual configuration need not be limited to a supporting foot. Rather, base portion 14 may be provided by any structure sufficiently supporting the platform member in a stable orientation. In other embodiments of the present invention, the support portion may be secured to the feet 20 and 22 using any suitable mounting method. Similarly, the two support posts may be replaced by a single support post, or by several support posts.

Platform member 18 is cantilever mounted to support posts 24 and 26 by mounting means or assembly 30, such as post engagement devices 32 and 34. The support posts preferably each have a surface 36 formed with a plurality of vertically adjacent notches 38. The post engagement device cooperates with notched surface 36 to secure the platform member in selected ones of a plurality of elevated positions. In the present embodiment, the components of post engagement device 32 are substantially similar to, and reversed relative to, those of post engagement device 34. Thus, only post engagement device 32 will be described in detail.

Post engagement device 32 includes a brace member 40 mounted to platform member 18. A binding assembly 42 having first and second securement pins 44 and 46, and being formed to engage support post 24, is secured to brace member 40. First pin 44 projects from the brace member at a position which will engage notched surface 36 when mounting the platform to frame assembly 12. Second pin 46 is laterally spaced from the first pin and projects from brace member 40 adjacent back surface 48 of the support post. A link member 50 mounted to the projecting ends of first and second pins 44 and 46 couples the first and second pins together for additional strength. The first and second pins, link member 50 and brace member 40 define an opening or enclosed area therebetween which is formed to receive support post 24.

Figure 2:
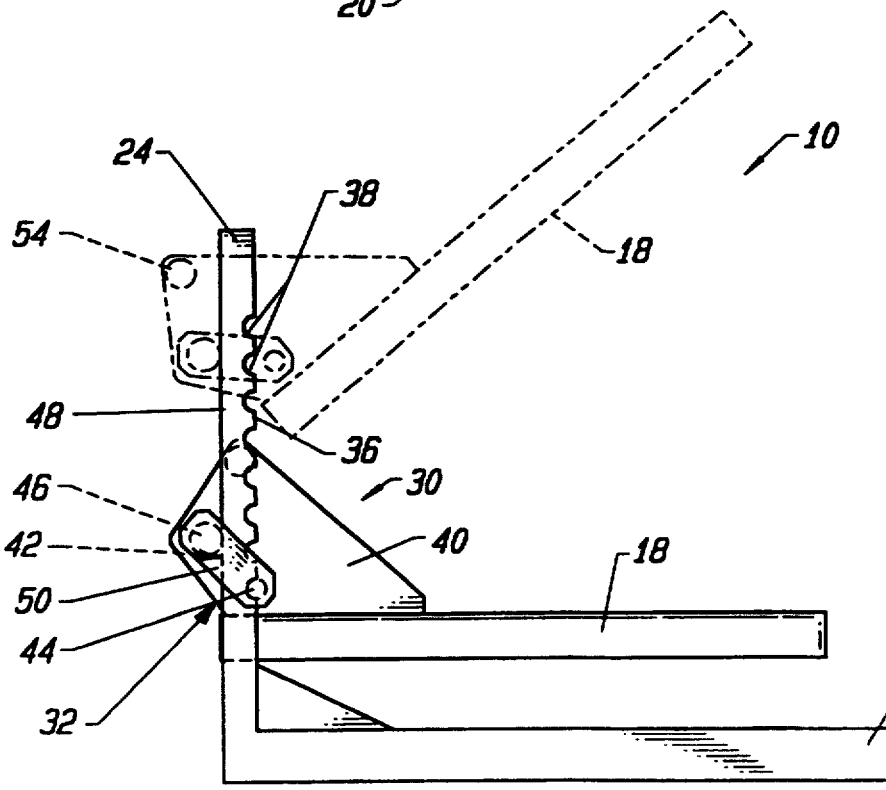
FIG. 2 is a side elevational view of a platform of FIG. 1, shown with the platform member in a weighted position and in phantom in an unweighted position.

When mounting platform member 18 to the frame, binding assembly 42 is slipped onto support post 24 in a tilted orientation, as shown in phantom in FIG. 2, with first securement pin 44 adjacent the notched surface, and second securement pin 46 adjacent the smooth back surface 48. As the platform member is rotated from the phantom position to the solid line, horizontally oriented position, the first securement pin is received by one of the notches 38. The weight of the platform member and the post engagement device exerts a moment force on the binding assembly driving first pin 44 into notch 38 and second pin 46 against back surface 48. Thus, the device cooperates with the notches formed in the support post to secure the platform member in a selected elevated position, with the platform in a stable, horizontal orientation. The additional weight contributed by a person standing upon the platform increases the amount of force applied by the post binding assembly, further securing the platform to the support posts.

With the work station of the present invention, platform member 18 is manually adjustable between a plurality of elevated positions. Each notch formed in notched surface 36 represents one elevated position. The elevated height of the platform member is determined by the location of the notch in which first pin 44 is secured. In the present embodiment, support post 24 includes eight, vertically spaced notches for adjustably positioning the platform member at one of eight heights above a support surface. In other embodiments, the support post may be formed having a greater number of notches, a longer notched surface, or fewer notches.

In the present embodiment, the post engagement device is mounted to the platform member, while the support post is formed having a notched surface. Alternatively, the post engagement device may be situated on the support portion and the notched surface provided on the platform member. The post engagement device and notched surface may be replaced by any suitable mounting means for adjustably cantilever mounting the platform member to the support portion. While the post engagement device is described as having one pin positioned to engage one of the notches, in alternative embodiments several pins may be positioned for engaging several notches of the support portion. Further, back surface 48 of the support post may similarly be formed with a plurality of notches engageable by the second securement pin and front surface 36 may be notched as shown or smooth.

The platform member may be conveniently and efficiently moved between different elevated positions by rotating the cantilevered end 52 of the platform relative to support post 24. As is shown by the phantom lines in FIG. 2, when platform member 18 is rotated to a tilted position, first securement pin 44 is released or disengaged from notch 38. The first and second securement pins are separated by a sufficient distance allowing the post engagement device to be moved along the length of the support post. The platform member is then moved along the support post until the first pin is positioned in front of a selected notch. The platform member is automatically secured in the selected elevated position by rotating the cantilevered end to a horizontal orientation. The first securement pin engages the selected notch, with the weighting of the platform firmly holding the pin 44 in place.

The work station 10 may be used by several workers of different heights without inconvenience or undue delay. This is of particular advantage for a manufacturing facility operating several shifts. A worker may also conveniently adjust the height of platform member 18 during his or her shift to accommodate changing working conditions. Thus, the present invention provides a platform for a work station offering the advantages of convenience and versatility.

The generally planar platform member 18 is of sufficient size to permit a person to stand upon the platform in a substantially upright position. A footrest 54 is provided at a front side of the platform to support a person's foot when standing upon work station 10. In the present embodiment, the foot rest is mounted to and extends between the brace members. The footrest is positioned so as not to interfere with the rotation of the cantilevered end of platform member 18 relative to the support posts.

The upper surface 56 of the platform member advantageously may be formed with a plurality of apertures 58 to provide slip resistance. A person may thereby more safely stand on platform member 18, particularly in applications in which slippery materials may fall upon the platform.

Figure 3:
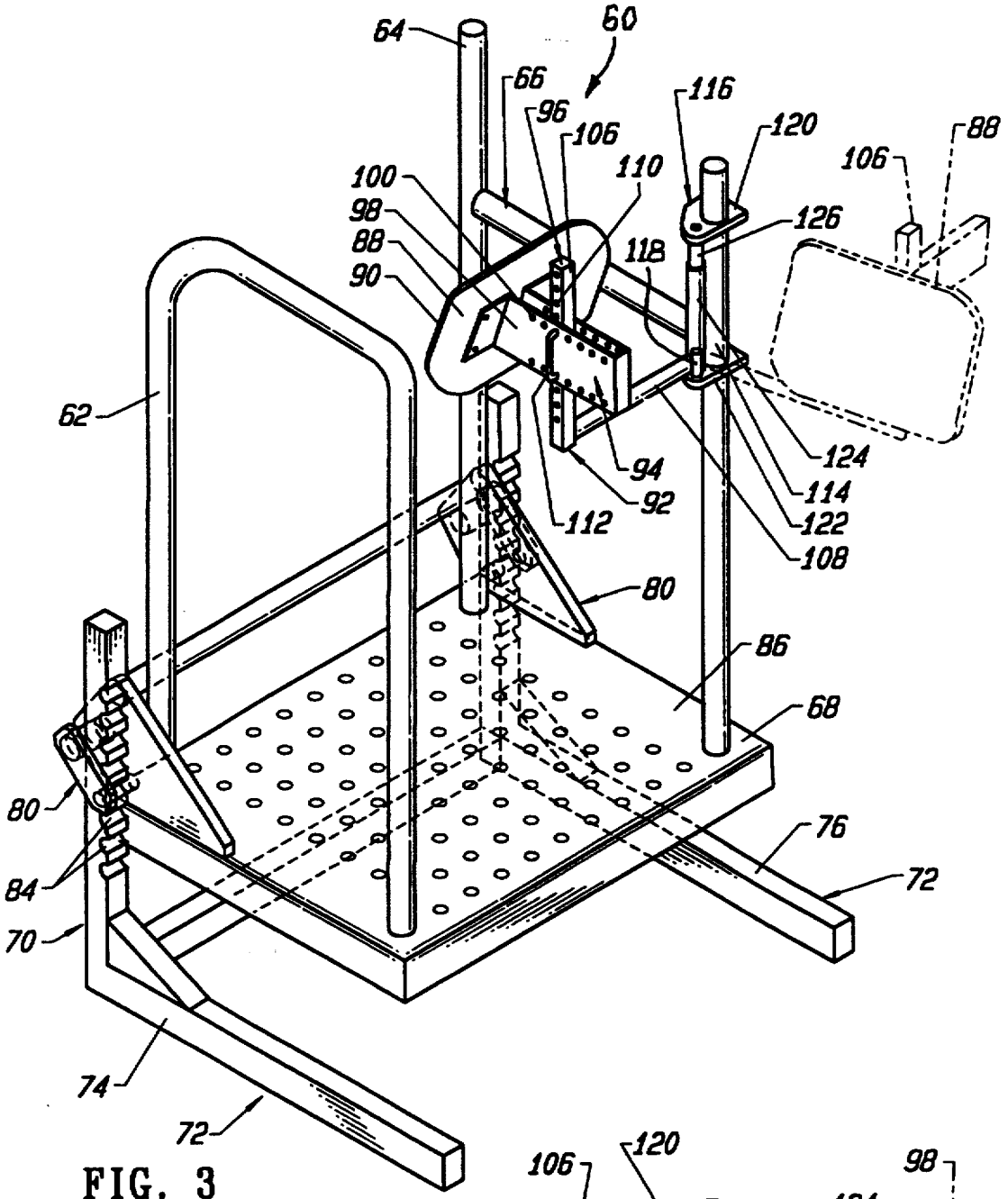
FIG. 3 is an isometric view of an alternative embodiment of a platform for use as a work station constructed in accordance with the present invention.
Figure 4:
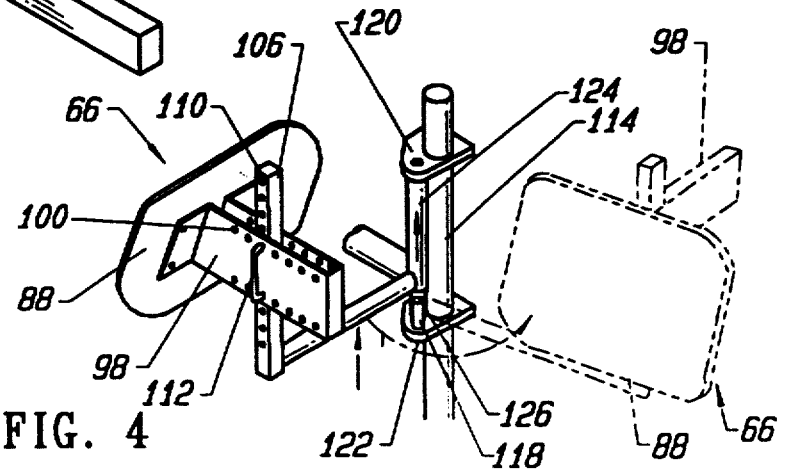
FIG. 4 is a fragmentary, isometric view of the support assembly of the platform of FIG. 3, shown with the seat support in a deployed position and in phantom in a stored position.

Turning now to FIGS. 3 and 4, an alternative embodiment of the work station platform of the present invention is represented. In this embodiment, a work station, generally designated 60, is provided with guardrails 62 and 64 and support means or assembly 66 for supporting a person at a position above the knees, preferably the person's buttocks, while in a standing position. The guardrails are provided as an additional safety and fatigue-reducing feature to prevent accidents and potential injury to a person standing on the platform. The support assembly enhances comfort and substantially reduces the development of physical fatigue in a person standing on the platform for extended periods of time.

As is shown particularly in FIG. 3, work station 60 includes a platform member 68 cantilever mounted to a frame having a support portion 70 and a base portion 72. As with the previously discussed embodiment, the support portion and the base portion are provided by first and second L-shaped members 74 and 76. The platform includes mounting means or post engagement assemblies 80 mounted to platform member 68, and a plurality of vertically spaced notches 84 formed on support portion 70. Post engagement assemblies 80 each engage one of notches 84 to support the platform member in a stable, horizontal orientation at a selected elevated position. As discussed above in relation to FIGS. 1 and 2, platform 68 is moved between selected positions by first rotating cantilevered end 85 relative to the support portion to disengage the post engagement device. The platform is then moved along support portion 70 to the desired position and returned to a horizontal orientation to secure the platform member in place.

Turning now to FIG. 4, support assembly 66 will be described in detail. In the present embodiment, the support assembly is mounted to guardrail 64. In other embodiments, the support assembly may include a post mounted to the platform member. The support assembly includes a body support member, such as a seat support 88, which has a surface 90 tilted or inclined to a vertical plane. When standing on platform member 68, a person may lean against the seat support to reduce lower back and leg strain. By providing support and lessening physical stress, the body member substantially increases the length of time over which a worker may comfortably stand upon the platform, thereby improving worker efficiency and productivity.

Support assembly 66 preferably further includes position adjustment means, generally designated 92, which has a lateral adjustment device 94 and a height adjustment device 96. Lateral adjustment device 94 allows seat support 88 to be moved in fore or aft directions across upper surface 86 to adjust the position of the seat support relative to the location of a person standing on platform member 68. Height adjustment device 96 enables the height of the seat support above platform 68 to be adjusted so as to enable adapting of support assembly 66 to the stature of a person standing on platform 60. Thus, the support assembly of the present invention may be adjusted to provide a person with maximum comfort and support.

In the present embodiment, the lateral adjustment device includes a horizontal support member 98 mounted to seat support 88. The horizontal support member 98 is generally U-shaped, and is formed having a plurality of horizontally spaced apertures 100 extending along support member 98 in parallel rows. The height adjustment device 96 is provided by a vertical support post 106. Vertical support post 106 is mounted to a laterally extending arm 108 centering support post 106 above the cantilevered end of platform 68. A plurality of vertically spaced apertures 110 are formed along support post 106 in a pattern which is matched with the apertures 100. When one of apertures 100 is aligned with one of the vertically spaced holes 110 on support post 106, a second aperture 100 in the parallel row is aligned with another of the vertically spaced holes 110.

Coupling means, such as link pin 112, joins the horizontal and vertical supports 98 and 106 together with the seat support held in a desired position. The link pin passes through a selected pair of apertures 100 to engage the corresponding holes 110 of the vertical support post, thereby coupling the support portions together. Seat support 88 may thereby be held in a selected one of a plurality of positions with the horizontal and lateral components determined respectively by support member 98 and support post 106. When the seat support is positioned generally at the desired location, the support portions are shifted until a pair of apertures 100 are aligned with apertures 110. Link pin 112 is inserted through the aligned apertures to retain seat support 88 in the selected position.

The efficient means of adjustment provided by the present invention has particular advantage when several different workers will use the work station 60. At the beginning of each shift, the worker may conveniently adjust the seat support for maximum comfort.

With guardrails 62 and 64 and seat support 88 in the solid line position of FIG. 3, access to platform member 68 is substantially restricted. If the work station 60 is placed immediately adjacent to a conveyor belt or stationary work station, the worker would have to squeeze around the guardrails and the seat support. As is shown in FIG. 4, to avoid this inconvenience seat support 88 is movable between a deployed position for supporting a person, and a stored position (represented by the phantom lines) for providing access to the platform.

The support assembly 66 includes deployment means for manually moving the seat support between the two positions. Thus, a bracket assembly 116 is provided for pivotably mounting seat support 88 to post 114. Bracket assembly 116 includes upper and lower vertically spaced brackets 120 and 122 fixedly mounted to post 114. A sleeve 124 is slidably and rotatably mounted to a vertical rod 126 extending between the upper and lower brackets. Transversely extending arm 108 is mounted to the sleeve for pivoting seat support 88 between the deployed position and the stored position. When in the deployed position, arm 108 engages stop peg 118, mounted to lower bracket 122. The peg prevents arm 108 from pivoting rearwardly about vertical rod 126, thereby securing the seat support in the deployed position.

Turning now to FIG. 4, the transfer of the seat support from the deployed position to the stored position will be discussed in more detail. Sleeve 124 and arm 108, carrying seat support 88, are vertically movable along rod 126 in an axial direction between an engaged position (FIG. 3), securing seat support 88 in the deployed position, and a disengaged position (FIG. 4), for pivoting the seat support about vertical rod 126. When the sleeve and arm are in the engaged position and the seat support is in the deployed position, arm 108 is pressed against stop peg 118. Thus, pivoting of the arm is prevented and a person may safely lean against, and be supported by, seat support 88.

When a worker desires to step up to, or down from, platform member 68, the seat support may be conveniently and efficiently moved from the deployed position to the stored position. To release the deployed seat support 88, sleeve 124 and arm 108 are moved to the disengaged position, raising arm 108 above peg 128. The sleeve is then rotated, pivoting the arm about vertical rod 126 and moving the deployed seat support to the phantom line position. The sleeve is then lowered on the other side of peg or stop 118 and the seat support is held in the stored position, providing access to the platform member. Once a worker is standing on platform 60, stored seat support 88 is deployed by sliding sleeve 124 upwardly to the disengaged position and pivoting arm 108 in the opposite direction. Sleeve 124 is then moved down along the vertical rod to the engaged position, lowering the arm 108 against peg 118, securing the seat support in the deployed position.

What is claimed is:

1. A portable, manually-adjustable platform for use as a work station on a support surface comprising:

(a) frame means having a base portion suitable for positioning on said support surface and a support portion extending vertically from said base portion;

(b) platform means having a size sufficient to support a person in a standing position thereon;

(c) mounting means cantilever mounting said platform means to extend from at least one side of said support portion, said mounting means being further formed for manual release of said platform means for movement along said support portion between a plurality of elevated positions upon unweighting of said platform means, and said mounting means automatically securing said platform means in a selected one of said plurality of elevated positions upon weighting of said platform means;

(d) said base portion further being movable with respect to, and self-supporting on said support surface and extending laterally from said support portion by an amount sufficient to support said platform means in a stable elevated position over said support surface with a person standing at any location on said platform means; and support means carried by said platform means for supporting a person by engagement with said person above the knees when standing in a substantially upright position on said platform means such that when a person stands upon said platform means, the person may lean against said support means.

2. The platform of claim 1 wherein, said support portion includes at least one support post and one of said first and second engagement surfaces is provided by a notched surface including a plurality of vertically adjacent notches on said support post, said pin means being formed for cooperative engagement with said notches to secure said platform means in one of said plurality of elevated positions.

3. The platform of claim 2 wherein, said support post is substantially vertically oriented and formed with said notches; and said pin means is mounted to said platform means.

4. The platform of claim 1 wherein, said pin means is configured to engage at least one of said notches when said platform means has a horizontal orientation and to disengage said at least one of said notches when said platform means has a tilted orientation; and said mounting means is further formed for movement of said platform means between said horizontal orientation for securing said platform means in one of said plurality of elevated positions and said tilted orientation for releasing said platform means from said one of said plurality of elevated positions.

5. The platform of claim 1 wherein, said platform means has an upper surface which is substantially slip resistant.

6. A portable, manually-adjustable platform for use as a work station on a support surface comprising:

frame means having a base portion suitable for positioning on said support surface and a support portion extending vertically from said base portion said support portion having first and second engagement surfaces and including at least substantially vertically oriented support post, one of said first and second engagement surfaces being provided by notched surface including a plurality of vertically adjacent notches on said support post, said support post having a smooth surface opposite said notched surface;

platform means having a horizontally extending support surface of a size sufficient to support a person in a standing position thereon;

mounting means cantilever mounting said platform means to extend from at least one side of said support portion, said mounting means including pin means having a first securement pin in cooperative engagement with one of said first and second engagement surfaces and a second securement pin engaging the other of said first and second engagement surfaces at a position above said first securement pin, said first securement pin being positioned for engagement with said notched surface, and said second securement pin being positioned for engagement with said smooth surface for securing said first securement pin in said one of said notches, said mounting means being further formed for manual release of said platform means for movement along said support portion between a plurality of elevated positions upon unweighting of said platform means, and said mounting means automatically securing said platform means in selected one of said plurality of elevated positions upon weighting of said platform means, said pin means being formed for cooperative engagement with said notches to secure said platform means in one of said plurality of elevated positions;

said base portion further being movable with respect to, and self-supporting on, said support surface and extending laterally from said support portion by an amount sufficient to support said platform means in a stable elevated position over said support surface with a person standing at any location on said platform means.

7. The platform of claim 6 wherein, said mounting means includes a brace member mounted to said platform means, said first securement pin being attached to said brace member at a first position, said second securement pin being attached to said brace member at a second position vertically spaced from said first position.

8. A portable, manually-adjustable platform for use as a work station on a support surface comprising:

frame means having a base portion suitable for positioning on said support surface and a support portion extending vertically from said base portion, said support portion having first and second engagement surfaces and including at least one support post, said first and second engagement surfaces being provided by a notched surface including a plurality of vertically adjacent notches on said support post, said support portion including a second support post complementary to said first-mentioned support post, said second support post being formed with a notched surface having a plurality of vertically adjacent notches;

platform means having a horizontally extending support surface of a size sufficient to support a person in a standing position thereon;

mounting means cantilever mounting said platform means to extend from at least one side of said support portion, said mounting means including pin means having a first securement pin in cooperative engagement with one of said first and second engagement surfaces and a second securement pin engaging the other of said first and second engagement surfaces at a position above said first securement pin, said mounting means being further formed for manual release of said platform means for movement along said support portion between a plurality of elevated positions upon unweighting of said platform means, and said mounting means automatically securing said platform means in a selected one of said plurality of elevated positions upon weighting of said platform means;

said base portion further being movable with respect to, and self-supporting on, said support surface and extending laterally from said support portion by an amount sufficient to support said platform means in a stable elevated position over said support surface with a person standing at any location or said platform means;

said first-mentioned support post being positioned adjacent one side of said platform means, and said second support post being positioned adjacent an opposite side of said platform means; and said pin means being formed for receipt in and cooperation with said notches to secure said platform means in one of said plurality of elevated positions.

9. A portable, manually-adjustable platform for use as a work station on a support surface comprising:

frame means having a base portion suitable for positioning on said support surface and a support portion extending vertically from said base portion, said support portion having first and second engagement surfaces;

platform means having a horizontally extending support surface of a size sufficient to support a person in a standing position thereon;

mounting means cantilever mounting said platform means to extend from at least one side of said support portion, said mounting meads including pin means having a first securement pin in cooperative engagement with one of said first and second engagement surfaces and a second securement pin engaging the other of said first and second engagement surfaces at a position above said first securement pin, said mounting means being further formed for manual release of said platform means for movement along said support portion between a plurality of elevated positions upon unweighting of said platform means, and said mounting means automatically securing said platform means in a selected one of said plurality of elevated positions upon weighting of said platform means;

said base portion further being movable with respect to, and self-supporting on, said support surface and extending laterally from said support portion by an amount sufficient to support said platform means in a stable elevated position over said support surface with a person standing at any location on said platform means; and said base portion including a pair of feet extending from said support portion outwardly of opposite sides of said platform means for a distance greater than the cantilevered length of said platform means.

10. A portable, manually-adjustable platform for use as a work station on a support surface comprising:

frame means having a base portion suitable for positioning on said support surface and a support portion extending vertically from said base portion, said support portion having first and second engagement surfaces;

platform means having a horizontally extending support surface of a size sufficient to support a person in a standing position thereon;

mounting means cantilever mounting said platform means to extend from at least one side of said support portion, said mounting means including pin means having a first securement pin in cooperative engagement with one of said first and second engagement surfaces and a second securement pin engaging the other of said first and second engagement surfaces at a position above said first securement pin, said mounting means being further formed for manual release of said platform means for movement along said support portion between a plurality of elevated positions upon unweighting of said platform means, and said mounting means automatically securing said platform means in a selected one of said plurality of elevated positions upon weighting of said platform means;

said base portion further being movable with respect to, and self-supporting on, said support surface and extending laterally from said support portion by an amount sufficient to support said platform means in a stable elevated position over said support surface with a person standing at any location on said platform means; and at least one guardrail upwardly projecting from said platform means to a height preventing a person standing on said platform means from falling off said platform means.

11. A portable, manually-adjustable platform for use as a work station on a support surface comprising:

frame means having a base portion suitable for positioning on said support surface and a support portion extending vertically from said base portion, said support portion having first and second engagement surfaces;

platform means having a horizontally extending support surface of a size sufficient to support a person in a standing position thereon;

mounting means cantilever mounting said platform means to extend from at least one side of said support portion, said mounting means including pin means having a first securement pin in cooperative engagement with one of said first and second engagement surfaces and a second securement pin engaging the other of said first and second engagement surfaces at a position above said first securement pin, said mounting means being further formed for manual release of said platform means for movement along said support portion between a plurality of elevated position upon unweighting of said platform means, and said mounting means automatically securing said platform means in a selected one of said plurality of elevated positions upon weighting of said platform means;

said base portion further being movable with respect to, and self-supporting on, said support surface and extending laterally from said support portion by an amount sufficient to support said platform means in a stable elevated position over said support surface with a person standing at any location on said platform means; and a footrest carried by said platform means at one end thereof to provide support for a foot in a position elevated relative to said platform means when a person is standing upon said platform means.

12. A portable, manually-adjustable platform for use as a work station on a support surface comprising:

(a) frame means having a base portion suitable for positioning on said support surface and a support portion extending vertically from said base portion;

(b) platform means having a size sufficient to support a person in a standing position thereon;

(c) mounting means cantilever mounting said platform means to extend from at least one side of said support portion in one of a plurality of elevated positions relative to said base portion, said mounting means being further formed for manual release of said platform means for movement between said plurality of elevated positions upon unweighting and rotation of said platform means, and said mounting means being formed for automatic securing of said platform means in a selected one of said plurality of elevated positions upon reverse rotation and weighting of said platform means;

(d) said base portion further being movable with respect to, and self-supporting on, said support surface and extending laterally from said support portion by an amount sufficient to support said platform means in a stable elevated position over said support surface with a person standing at any location on said platform means; and (e) support means carried by said platform means for supporting a person by engagement therewith above the knees when standing in a substantially upright position on said platform means such that when a person stands upon said platform means, the person may lean against said support means.

13. The platform of claim 12 wherein, said support means includes a seat support and position adjustment means for adjusting the placement of said seat support relative to a person standing upon said platform means.

14. The platform of claim 13 wherein, said position adjustment means includes lateral adjustment means for adjusting the placement of said seat support relative to the position at which a person stands upon said platform means and height adjustment means for adjusting the positioning of said seat support relative to the height of a person standing upon said platform means

15. The platform of claim 12 wherein, said support means includes a seat support and deployment means for movement of said seat support between a deployed position for supporting a person by engagement therewith and a stored position for providing access to said platform means.

16. The platform of claim 12, and at least one guardrail upwardly projecting from said platform means to a height preventing a person standing thereon from falling off said platform means.

17. The platform of claim 16 wherein, said support means is mounted to said guardrail.

18. A work station apparatus with support means for supporting a person when standing on a work station platform comprising:

a seat support mounted to and extending above the platform and formed for supporting a person by engagement with the person at a position above the person's knees;

position adjustment means mounted to said seat support for positioning said seat support in a selected one of a plurality of positions, said position adjustment means including lateral adjustment means for adjusting the placement of said seat support relative to the position at which a person stands upon said platform, and height adjustment means for adjusting the positioning of said seat support relative to the height of a person standing upon said platform;

deployment means mounting said seat support for movement between a deployed position, for supporting a person by engagement therewith when standing in a substantially upright position on said platform, and a stored position, for providing access to said platform;

said lateral adjustment means includes a first support portion having a plurality of laterally spaced apertures formed therein;

said height adjustment means includes a second support portion having a plurality of vertically spaced apertures formed therein;

said seat support is mounted to one of said first and second support portions; and said position adjustment means includes coupling means for coupling said first support portion to said second support portion with said seat support in one of a plurality of positions relative to a person standing upon said platform, said coupling means being further formed for engaging at least one of said laterally spaced apertures and at least one of said vertically spaced apertures to secure said first support portion to said second support portion with said seat support in one of said plurality of positions, and said coupling means being formed for manual release of said first and second support portions for movement of said seat support between said plurality of positions.

19. A work station apparatus with support means for supporting a person when standing on a work station platform comprising:

support means mounted to and extending above the platform and formed for supporting a person by engagement with person at a position above the person's knees, said support means being provided by a seat support carried by a laterally extending arm;

position adjustment means mounted to said support means for positioning said support means in a selected one of a plurality of positions;

deployment means mounting said support means for movement between a deployed position, for supporting a person by engagement therewith when standing in a substantially upright position on said platform, and a stored position, for providing access to said platform, said deployment means including a vertically extending post and bracket means for pivotably mounting said arm to said post, said bracket means being further formed for pivoting said arm about said post for movement of said seat support between said deployed position and said stored position, said deployment means further including stop means for securing said support means in said deployed position, said deployment means being further formed for manually releasing said support means from said stop means for movement of said support means between said deployed position and said stored position, and said stop means and said arm to prevent pivoting thereof to secure said seat support in said deployed position.

20. The apparatus of claim 19 wherein, said bracket means includes a pair of vertically spaced brackets mounted to said post, and said stop means includes a peg mounted to one of said brackets, said peg being positioned to engage said arm to secure said seat support in said deployed position.

21. The apparatus of claim 19 wherein, said bracket means includes a vertically extending rod positioned adjacent said post and a sleeve slidably mounted on said rod, said sleeve being formed for movement in an axial direction between an engaged position for engaging said stop means to secure said seat support in said deployed position and a disengaged position for disengaging said stop means to move said seat support between said deployed position and said stored position, said sleeve being further formed for movement in a radial direction for pivoting of said arm about said post to move said seat support between said deployed position and said stored position.

22. A work station apparatus with support means for supporting a person when standing on a work station platform comprising:

support means mounted to and extending above a work station platform and formed for supporting a person by engagement with the person at a position above the person's knees;

position adjustment means mounted to said support means for positioning said support means in a selected one of plurality of positions;

deployment means mounting said support means for movement between a deployed position, for supporting a person by engagement therewith when standing in a substantially upright position on said platform, and a stored position, for providing access to said platform;

said platform includes frame means having a base portion suitable for positioning on said support surface and a support portion extending vertically from said base portion, and mounting means cantilever mounting said platform means to extend from at least one side of said support portion in one of a plurality of elevated positions relative to said base portion; and said mounting means being further formed for manual release of said platform means for movement between said plurality of elevated positions upon unweighting of said platform means, and said mounting means being formed for automatic securing of said platform means in a selected one of said plurality of elevated positions upon weighting of said platform means.

* * * * *

UNITED STATES PATENT AND TRADEMARK OFFICE

CERTIFICATE OF CORRECTION

PATENT NO. : 5,365,860

DATED : November 22, 1994

INVENTOR(S) : Charles J. Billington, III

It is certified that error appears in the above-identified patent and that said Letters Patent is hereby corrected as shown below:

Column 10, Claim 6, line 49, after "least" insert --one--.

Column 10, Claim 6, line 52, after "by" insert --a--.

Column 15, Claim 19, line 53, after "means" delete "and" and replace with --engaging--.

Signed and Sealed this

Fourteenth Day of March, 1995

*Attest:*

*Attesting Officer*

BRUCE LEHMAN

*Commissioner of Patents and Trademarks*